US005203676A

United States Patent [19]

Ferleger et al.

[11] Patent Number: 5,203,676

[45] Date of Patent: Apr. 20, 1993

[54] RUGGEDIZED TAPERED TWISTED INTEGRAL SHROUD BLADE

[75] Inventors: Jurek Ferleger, Longwood; Shun Chen, Winter Springs, both of Fla.

[73] Assignee: Westinghouse Electric Corp., Pittsburgh, Pa.

[21] Appl. No.: 846,103

[22] Filed: Mar. 5, 1992

[51] Int. Cl.[5] ..... F01D 5/14; F01D 5/16

[52] U.S. Cl. ..... 416/223 A; 416/191; 416/500

[58] Field of Search ..... 416/190, 191, 223 A, 416/500, DIG. 2; 29/889.7

[56] References Cited

U.S. PATENT DOCUMENTS

| | | | |
|---|---|---|---|
| 4,076,455 | 2/1978 | Stargardter | 416/500 |
| 4,585,395 | 4/1986 | Nourse et al. | 416/223 A |
| 4,682,935 | 7/1987 | Martin | 416/223 A |
| 4,747,237 | 5/1988 | Giebmanns | 29/889.7 |
| 4,900,230 | 2/1990 | Patel | 416/DIG. 2 |
| 5,044,885 | 9/1991 | Odoul et al. | 416/223 A |
| 5,156,529 | 10/1992 | Ferleger et al. | 416/190 |

FOREIGN PATENT DOCUMENTS

| | | | |
|---|---|---|---|
| 2144600 | 3/1973 | Fed. Rep. of Germany | 416/223 A |

*Primary Examiner*—Edward K. Look
*Assistant Examiner*—James A. Larson

[57] ABSTRACT

A tapered twisted rotating blade for the fourth rotating blade row of a BB71 and BB471 turbine has a shroud segment integrally formed on the tip of the airfoil portion such that the shroud is dimensionalized according to materials used so that the tuned frequencies remain the same regardless of materials used, based on changes in Young's modulus due to use of different materials. The blade also has a pitch to chord ratio that increases linearly with length of the blade.

5 Claims, 7 Drawing Sheets

RUGGEDIZED TAPERED TWISTED INTEGRAL SHROUD BLADE

BACKGROUND OF THE INVENTION

1. Field of the Invention

The present invention relates generally to steam turbine blades and, more particularly, to an L-3R tapered twisted integral shroud rotating blade having improved performance characteristics.

2. Description of the Related Art

Rotating and stationary blades of a steam turbine are arranged in a plurality of rows or stages. The rotating blades of a given row are usually shaped identical to each other, except in the case of mixed tuned blades, and are mounted in corresponding mounting grooves provided in the turbine rotor. Stationary blades, on the other hand, are mounted on a cylinder which surrounds the rotor.

The rotating blades of a turbine, regardless of which row they are in, typically share the same basic components, as shown in FIG. 1 herein. Each has a root portion 13 receivable in the corresponding mounting groove of the rotor, a platform portion 15 which overlies the outer surface of the rotor at the upper terminus of the root 13, and an airfoil portion 17 which extends upwardly from the platform portion.

Stationary blades also have airfoils, except that the airfoil portions of the stationary blades extend downwardly towards the rotor. The airfoil portions of both stationary and rotating blades typically include a leading edge 22, a trailing edge 26, a concave pressure side surface 18, and a convex suction-side surface 14.

The airfoil shape common to a particular row of blades differs from the airfoil shape for every other row within a particular turbine. In general, no two turbines of different designs share airfoils of the same shape.

The structural differences in airfoil shape result in significant variations in aerodynamic characteristics, stress patterns, operating temperature, and natural frequency of the blade. These variations, in turn, determine the operating life of the turbine blade within the boundary conditions (turbine inlet temperature, pressure ratio, and rotational speed), which are generally determined prior to airfoil shape development.

Development of a turbine for a new commercial power generation steam turbine may require several years to complete. When designing rotating blades for a new steam turbine, a profile developer is given a certain flow field with which to work. The flow field determines the inlet angles (for steam passing between adjacent blades of a row), gauging, and the force applied on each blade, among other things. "Gauging" is the ratio of throat to pitch, "throat" is the straight line distance between the trailing edge of one blade and the suction surface of an adjacent blade, and "pitch" is the distance in the tangential direction between the trailing edges of the adjacent blades.

These flow field parameters are dependent on a number of factors, including the length of the blades of a particular row. The length of the blades is established early in the design of the steam turbine and is essentially a function of the overall power output of the steam turbine and the power output for that particular stage.

Referring to FIG. 2, two adjacent blades of a row are illustrated in sectional views to demonstrate some of the features of a typical blade. The two blades are referred to by the numerals 10 and 12. The blades have convex, suction-side surfaces 14 and 16, concave pressure-side surfaces 18 and 20, leading edges 22 and 24, and trailing edges 26 and 28, respectively.

The throat is indicated in FIG. 1 by the letter "O", which is the shortest straight line distance between the trailing edge of blade 10 and the suction-side surface of blade 12. The pitch is indicated by the letter "S", which represents the straight line distance between the trailing edges of the two adjacent blades.

The width of the blade is indicated by the distance $W_m$, while the blade inlet flow angle is $\alpha 1$, and the outlet flow angle is $\alpha 2$.

"$\beta$" is the leading edge included flow angle, and the letter "s" refers to the stagger angle.

When working with the flow field of a particular turbine, it is important to consider the interaction of adjacent rows of blades. The preceding row affects the following row by potentially creating a mass flow rate near the base which cannot pass through the following row. Thus, it is important to design a blade with proper flow distribution up and down the blade length.

The pressure distribution along the concave and convex surfaces of the blade can result in secondary flow which results in blading inefficiency. These secondary flow losses result from differences in steam velocity between the suction and the pressure surfaces of the blades.

A rotating blade can be "free-standing", in that there is no interconnection between adjacent blades in the upper region of the airfoils, or it can be interconnected at the tip with an adjacent blade or blades through a shroud segment. Shroud segments can be either integrally formed on the tip of each blade, or separately connected by attachment to a tenon formed on each blade tip.

Moreover, rotating and stationary blades can be either straight parallel-sided or tapered twisted. In a tapered twisted blade, center lines of the leading and trailing edges are non-parallel, owing to the changing geometry of the blade along its length. Conversely, since each cross section of a parallel-sided blade is identical, the center lines of the leading and trailing edges will be parallel.

The fourth stage of a Westinghouse Electric Corporation (the Assignee of the present invention) building block (BB) 71 low pressure turbine presently includes a row of rotating blades of the aforementioned parallel-sided configuration. This blade was designed without regard to three-dimensional flow field analysis.

Tuning of resonant frequencies is an additional important consideration when undertaking the design of a new blade. In some instances, different blade materials will be chosen depending on design criteria. The particular material used has a direct effect on Young's modulus, which in turn has an effect on blade frequency. Thus, according to currently available blade technology, a blade design having tuned frequencies with one material may have untuned frequencies when another material is substituted (for example, where the nickel percentage is different in one stainless steel than another).

SUMMARY OF THE INVENTION

An object of the present invention is to provide a tapered twisted integral shroud rotating turbine blade having improved performance and reliability.

Another object of the present invention is to provide a tapered twisted integral shroud rotating turbine blade having a shape designed to optimize resistance against high cycle fatigue failure.

These and other objects of the present invention are met by providing a tapered twisted rotating blade which includes a straight side-entry root portion, a platform portion, and an airfoil portion integrally formed with the platform portion and root portion and having a base section disposed at the platform portion thus constituting a proximal end of the airfoil portion and a tip section constituting an opposite distal end of the airfoil portion, and a shroud segment integrally formed on the airfoil portion at the tip section, wherein the shroud segment has a first dimension when the rotating blade is made of a first material and a second dimension when the blade is made of a second material.

These and other objects and features of the invention will become more apparent with reference to the following detailed description and drawings.

DETAILED DESCRIPTION OF THE PREFERRED EMBODIMENTS

Figure 2:
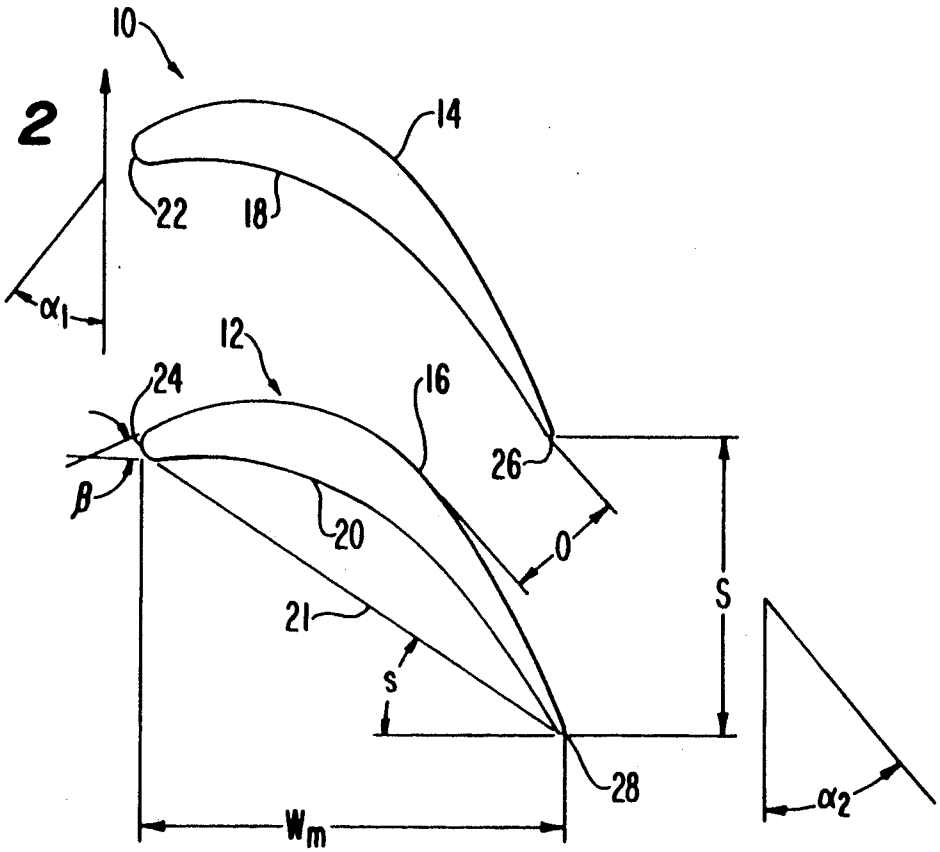
FIG. 2 is a schematic, sectional view, showing two adjacent blades at a typical section.
Figure 1:
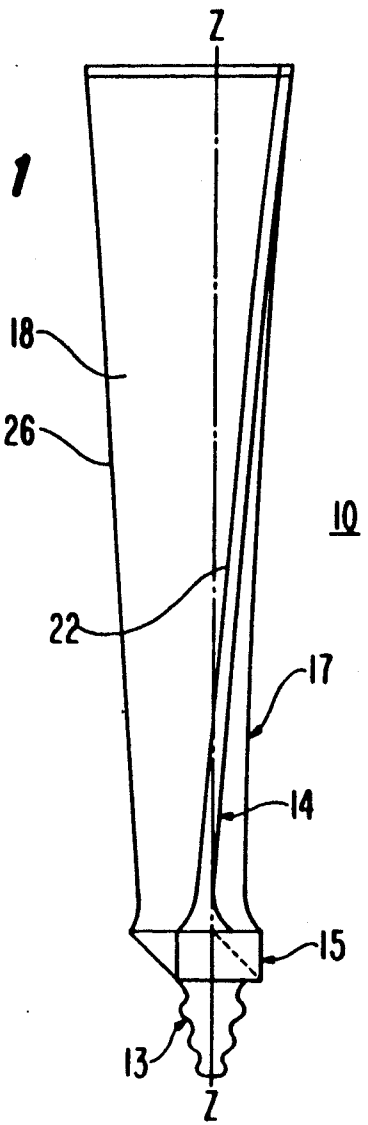
FIG. 1 is a tangential view of a turbine blade.
Figure 3:
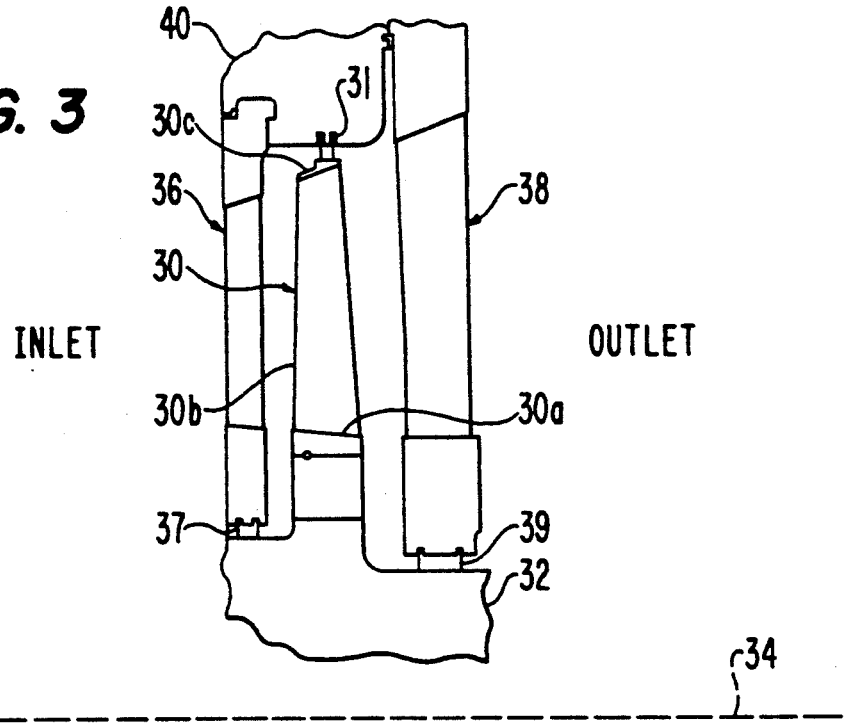
FIG. 3 is a partial side elevational view showing a rotating blade according to the present invention.

Referring to FIG. 3, this view of a steam turbine illustrates a blade 30 of the fourth row of rotating blades of either a BB71 or BB471 turbine. Each blade 30 of the fourth row is mounted on the rotor 32 which rotates about an axis 34. Stationary blade 36 of the fourth row of stationary blades, and stationary blade 38 of the fifth row of stationary blades are disposed on inlet and outlet sides, respectively, of the rotating blade 30 of the fourth row of rotating blades. Each of the stationary blades 36 and 38 is mounted on a cylinder 40 which surrounds the rotor 32. As illustrated, each of the stationary blades is provided with a steam seal 37,39 at its distal end, while for the rotating blades a steam seal 31 is mounted on the cylinder in opposition to the blade tip.

The rotating blade 30 includes a platform portion 30*a*, an airfoil portion 30*b*, and integral shroud portion 30*c*, and a root portion (not shown) which mounts the blade in a corresponding mounting groove of the rotor 32. The blade 30 is 7.23 inches long at the trailing edge and operates in a subsonic steam environment near saturation zone. The airfoil portion 30*b* was designed to achieve optimal radial distribution of blade inlet and exit angles (gauging) based on a three-dimensional flow field analysis. Inlet angles are influenced by the steam conditions leaving the upstream stationary blades 36. According to the present invention, the row of rotating blades which includes the rotating blade 30 is the first twisted row in the blade path of the BB71 turbine. The blade of the present invention is also used in the same row of a new BB471 turbine and is thus also the first twisted row of that turbine.

As the first twisted row in the blade path, the rotating blade 30 has a unique radial distribution of inlet angles which allows a smooth steam flow from the parallel-sided upstream blading. Compared to prior, parallel-sided blades designed to fit in the same stage, a tapered twisted airfoil shape, which uniquely matches steam flow conditions, offers improved stage performance and lower root stress. The unique shape of the blade provides optimized steam flow along the blade suction and pressure surfaces, with minimized secondary flow losses. This is manifest in the graph of FIG. 4, in which the triangular coordinate markers refer to the suction surface and the plus sign coordinate markers refer to the pressure surface of the airfoil for a typical blade section. The steam velocity was maintained subsonic to avoid condensation shock which adversely effects blade reliability.

Figure 5:
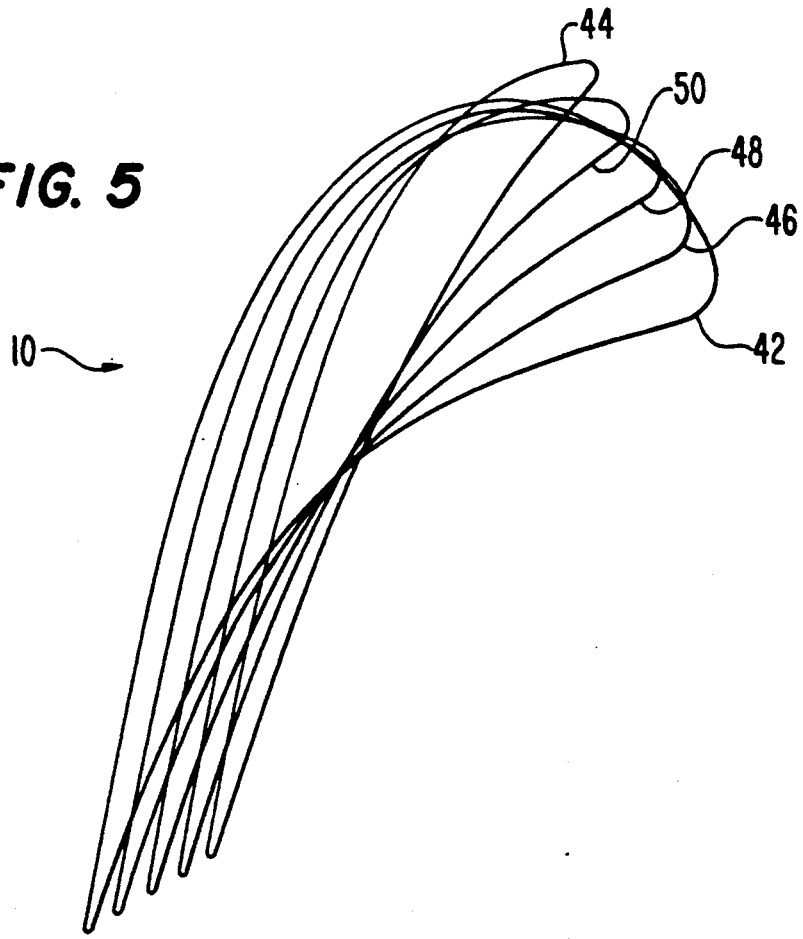
FIG. 5 is a stacked plot showing five basic sections of the airfoil portion of the rotating blade according to the present invention.
Figure 4:
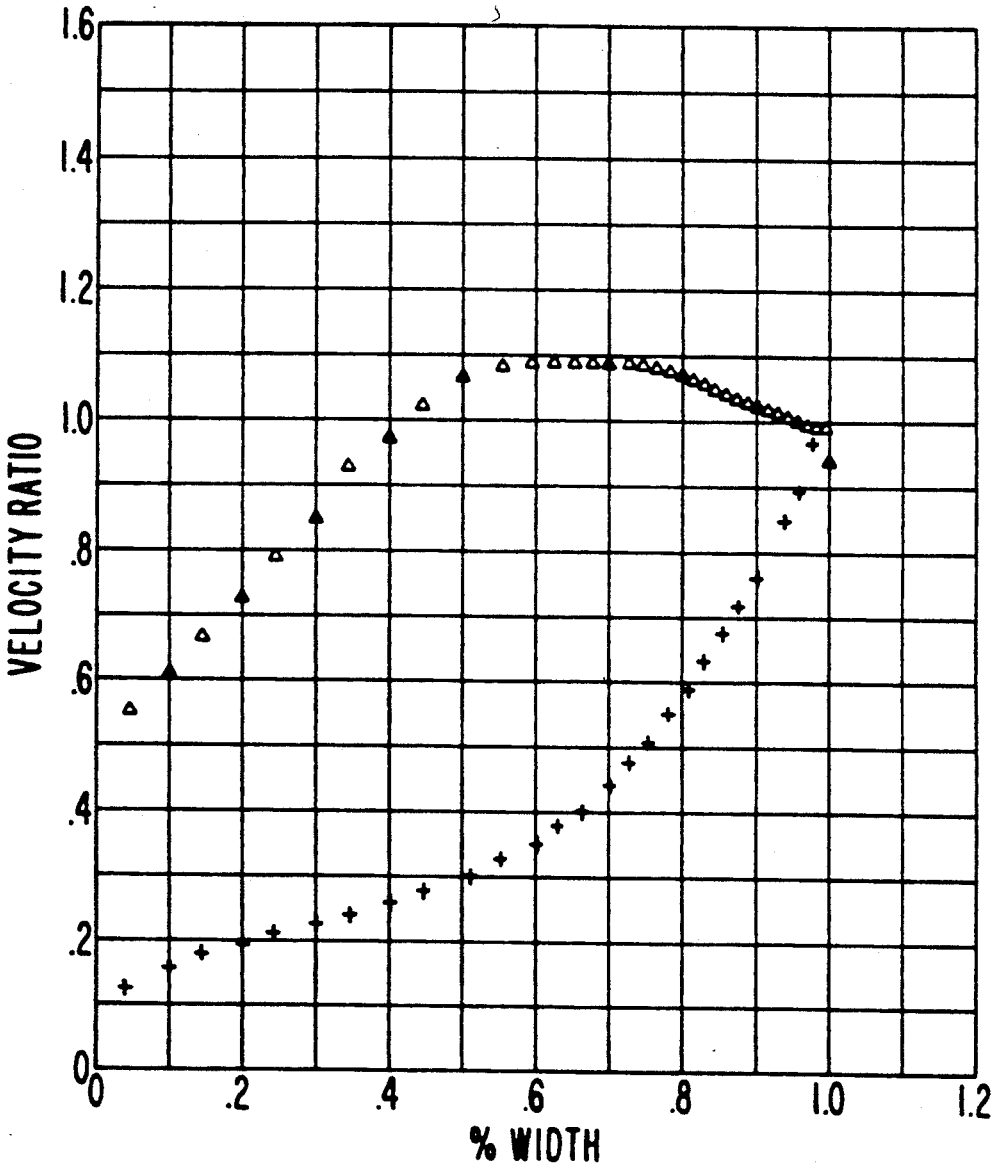
FIG. 4 is a chart showing the relationship of velocity ratio to width of the blade of a typical section.

FIG. 5 is a stacked plot showing the various blade sections for the airfoil portion of the blade 30. The base section 42 is a section taken through the airfoil portion at its lowermost plane, while the tip section 44 is taken through the uppermost plane of the airfoil portion. The stacked plot of FIG. 4 shows the general shape of the blade as its geometry changes with increasing length. The intermediate sections 46, 48, and 50 constituting the quarter, half and three quarters sections, respectively, are approximately equidistantly spaced between the base and tip sections.

The blade according to the present invention has the features detailed in the following table:

| | BASE | QUARTER | HALF | THREE QUARTER | TIP |
|---|---|---|---|---|---|
| RADIUS (IN) | 26.707 | 28.500 | 30.313 | 32.000 | 33.914 |
| WIDTH (IN) | 1.757 | 1.610 | 1.449 | 1.288 | 1.137 |
| CHORD (IN) | 2.432 | 2.396 | 2.358 | 2.338 | 2.328 |
| PITCH/WIDTH | .900 | 1.048 | 1.239 | 1.471 | 1.768 |
| PITCH/CHORD | .650 | .704 | .761 | .811 | .863 |
| STAGGER ANGLE (DEG) | 42.496 | 45.920 | 51.583 | 56.353 | 60.911 |
| MAXIMUM THICKNESS (IN) | .713 | .571 | .430 | .303 | .228 |
| MAX. THICKNESS/CHORD | .293 | .238 | .186 | .129 | .098 |
| TURNING ANGLE (DEG) | 103.000 | 91.239 | 15.126 | 51.114 | 46.590 |
| EXIT OPENING (IN) | .437 | .487 | .540 | .590 | .649 |
| EXIT OPENING ANGLE | 24.698 | 26.165 | 28.383 | 31.454 | 31.597 |
| INLET METAL ANGLE | 59.715 | 71.347 | 87.298 | 101.509 | 115.101 |
| INLET INCL. ANGLE | 82.389 | 74.336 | 57.438 | 43.312 | 39.916 |
| EXIT METAL ANGLE (DEG) | 17.283 | 17.413 | 17.575 | 17.375 | 18.308 |
| EXIT INCL. ANGLE (DEG) | 4.619 | 5.696 | 5.697 | 6.853 | 6.349 |

-continued

| | BASE | QUAR-TER | HALF | THREE QUAR-TER | TIP |
|---|---|---|---|---|---|
| SUCTION SURFACE TURNING | 9.723 | 11.601 | 13.658 | 17.505 | 15.464 |
| AREA (IN**2) | .993 | .782 | .583 | .436 | .340 |
| ALPHA (DEG) | 44.115 | 48.577 | 53.332 | 58.035 | 62.774 |
| FX (IN**(1-4)) | 13.494 | 27.966 | 65.818 | 170.108 | 468.529 |
| FY (IN**(1-4)) | 14.143 | 22.741 | 39.118 | 70.569 | 130.904 |
| FXY (IN**(1-4)) | 10.500 | 20.809 | 44.596 | 101.278 | 236.231 |
| I TOR (IN**4) | .080 | .043 | .019 | .007 | .003 |
| I MIN (IN**4) | .041 | .021 | .010 | .004 | .001 |
| I MAX (IN**4) | .301 | .228 | .169 | .133 | .106 |
| X BAR | .019 | .002 | −.013 | −.020 | −.012 |
| Y BAR | .017 | .019 | .012 | .007 | .010 |
| ZMINLE (IN**3) | −.077 | −.049 | −.028 | −.015 | −008 |
| ZMAXLE (IN**3) | .386 | .295 | .209 | .154 | .116 |
| ZMINTE (IN**3) | −.090 | −.059 | −.035 | −.020 | −.013 |
| ZMAXTE (IN**3) | −.785 | −.140 | −.109 | −.091 | −.076 |
| CMINLE (IN**3) | −.532 | −.439 | −.356 | −.276 | −.203 |
| CMAXLE (IN**3) | .781 | .773 | .807 | .863 | .913 |
| CMINTE (IN**3) | −.453 | −.365 | −.281 | −.207 | −.128 |
| CMAXTE (IN**3) | −1.690 | −1.621 | −1.536 | −1.462 | −1.398 |

Figure 6:
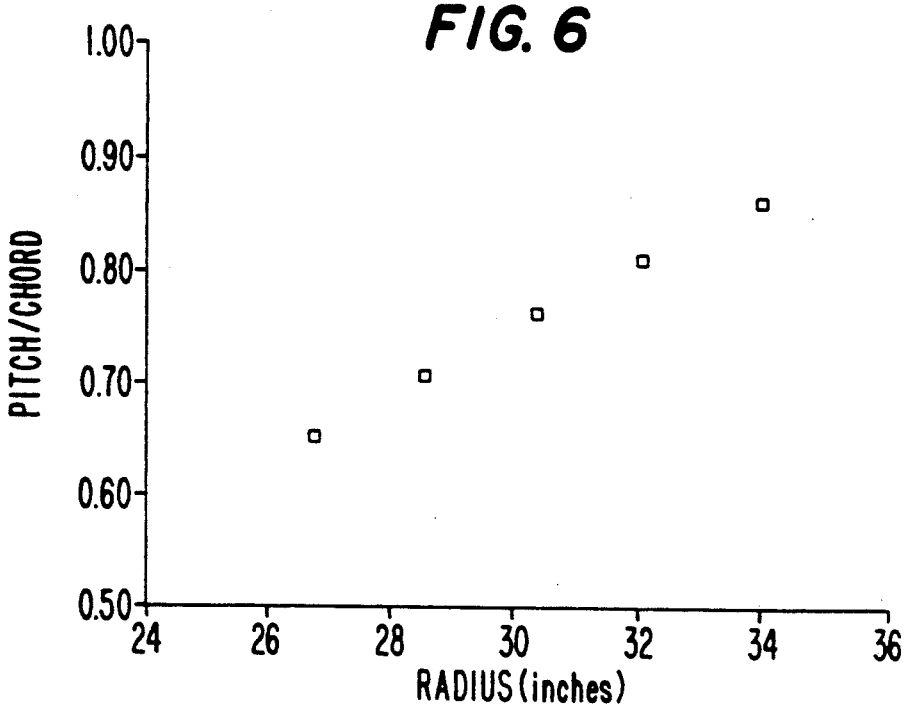
FIG. 6 is a graph showing the ratio of pitch to chord versus radius of the blade according to the present invention.

The unique shape of the present blade is also manifest in a linear radial distribution of pitch/chord ratio, as shown in FIG. 6. The radius refers to distance from the rotor center line to the base section of the airfoil portion of the blade 30. The five points along the graph in FIG. 6 refer to the five basic sections of the airfoil portion. Thus, the first point on the graph coincides with the base section of the airfoil portion, while the last point refers to the tip section. The linear radial distribution of pitch/chord ratio affords optimum performance without compromising strength parameters.

Figure 7:
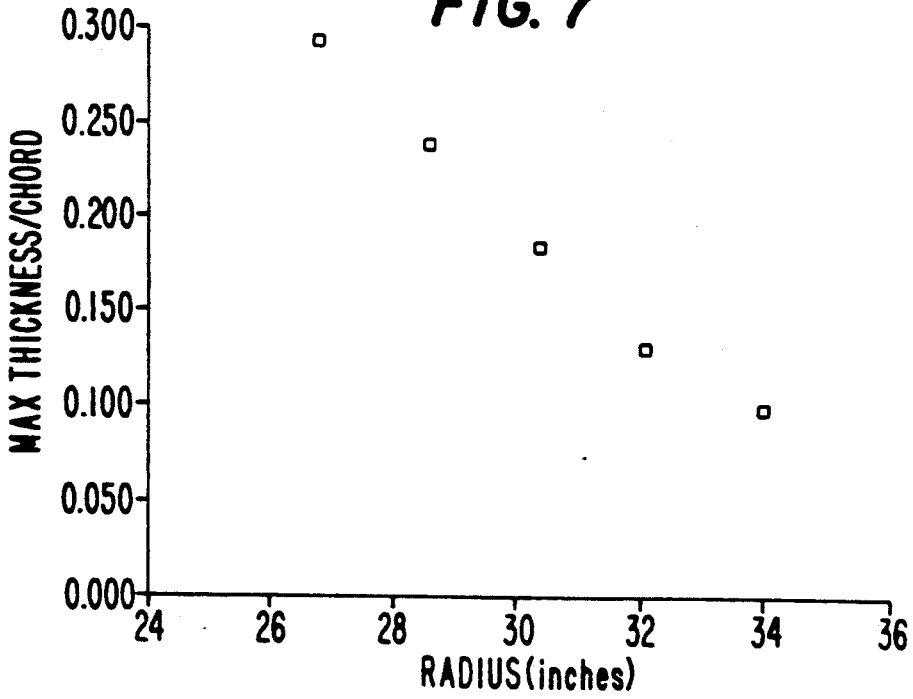
FIG. 7 is a graph showing the relationship of maximum thickness to chord versus radius.

FIG. 7 shows another characteristic of the present invention as a graph of maximum thickness/chord versus radius (or blade length). It can be seen from FIG. 7 that the radial blockage distribution is optimized without effecting strength of the airfoil at the base.

Another characteristic of the present blade which is believed to be unique is that the centers of the airfoil leading edge and trailing edge form straight lines in space, which simplifies blade manufacturing and gives a unique smooth shape.

To minimize eccentric stresses, the centroids of all of the sections of the blade airfoil are approximately above the centroid of the root. However, a small eccentricity is intentionally introduced to offset the steam flow tangential momentum. This can be demonstrated with reference to FIG. 8.

Figure 8:
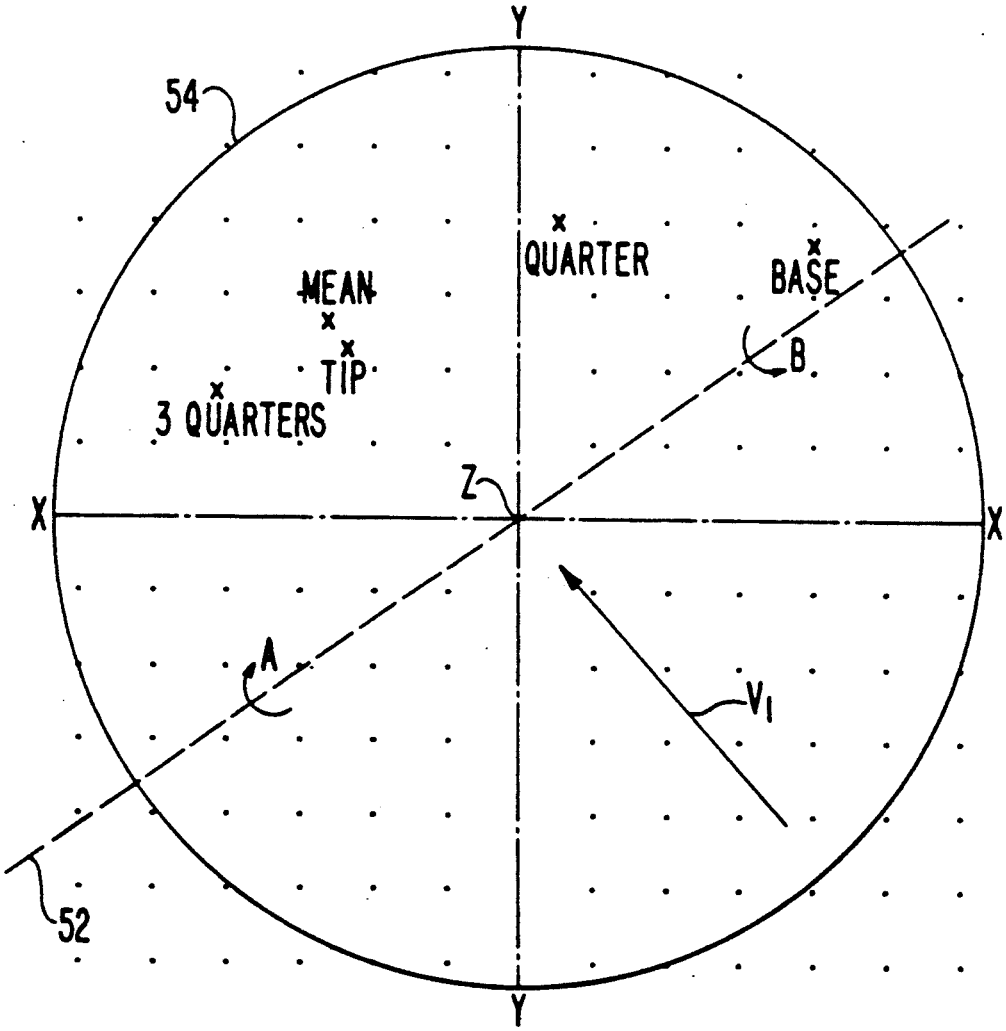
FIG. 8 is a graph showing the location of centers of gravity of the five basic sections according to the present invention.

FIG. 8 shows a plot of the X—X and Y—Y axes, the intersection of which defines the Z axis of the blade. The centroids of each of the five basic sections of the airfoil portion of the blade are illustrated as "X's". The dots within the large circle are at 5 mil spacings. Each centroid is labelled as corresponding to either the base section, the tip section, or one of the three intermediate sections denominated as the quarter section, means section and the three quarters section. The centroids correspond to the centers of gravity for each of the sections and these centers are located deliberately in an eccentric manner, with respect to the Z axis, to offset a force imparted on the blade due to steam bending. The airfoil portion has an approximate bending axis 52 about which the airfoil bends due to a force imparted by force vector $V_1$ which corresponds to a steam bending force. The steam bending force vector $V_1$ is normal to the bending axis 52 and causes or tends to cause the airfoil to bend in the direction of arrow A. However, a moment due to eccentricity is indicated by the arrow B and causes the blade or tends to cause the blade to return in the opposite direction of the bending moment so as to negate the effects of steam bending. In order to maximize the effective eccentricity, it is preferred that the centers of gravity of the basic sections of the airfoil lie on the opposite side of the bending axis 52. As shown in FIG. 8, all five of the centers lie in the first two quadrants of the X—X, Y—Y coordinate system. The circle 54 is intended to show a preestablished design limitation, beyond which the centers should not extend.

Another aspect of the present invention is that, with respect to the blading art in general, steam conditions require the use of different materials and thus, a blade designed to have a certain resonant frequency may become out of tune if a different material is used for a different application. Thus, one aspect of the present invention is to provide an envelope shroud, with respect to the integrally formed shroud of the present invention, so that, when going from one material to another, the frequencies can be changed to accept the levels by changing the dimensions of the shroud.

Figure 9:
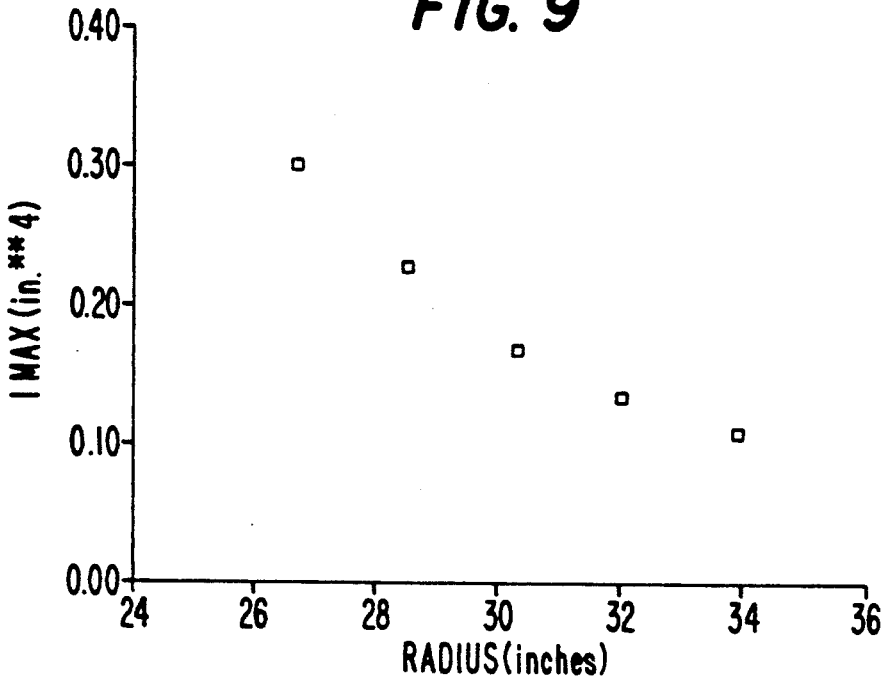
FIG. 9 is a graph showing IMAX versus radius according to the blade of the present invention.
Figure 10:
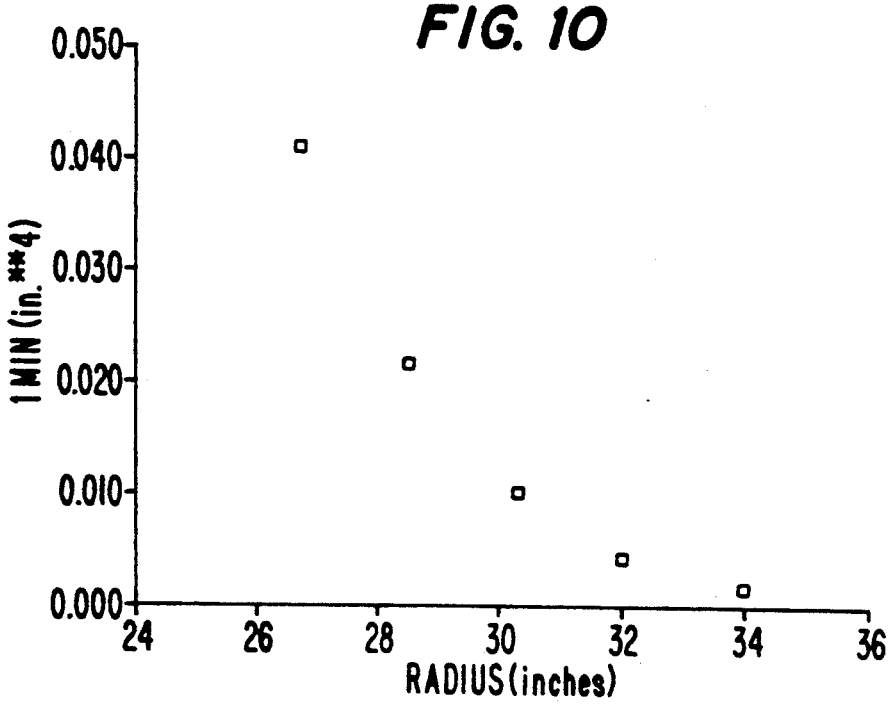
FIG. 10 is a graph showing the relationship to IMIN versus radius.

The shape of the airfoil portion according to the present invention is also designed to optimize resistance against high cycle fatigue failure. This is insured by both providing a structure strong enough to operate in harmonic resonance as well as controlling blade frequency to prevent such resonance. The fundamental frequency of an individual blade is positioned half way between the multiples or harmonics of turbine running speed. This is achieved through controlled radial distribution of airfoil minimum and maximum moments of area, IMIN and IMAX, as shown in FIGS. 9 and 10, as well as uniquely defined mass radial distribution.

Figure 11:
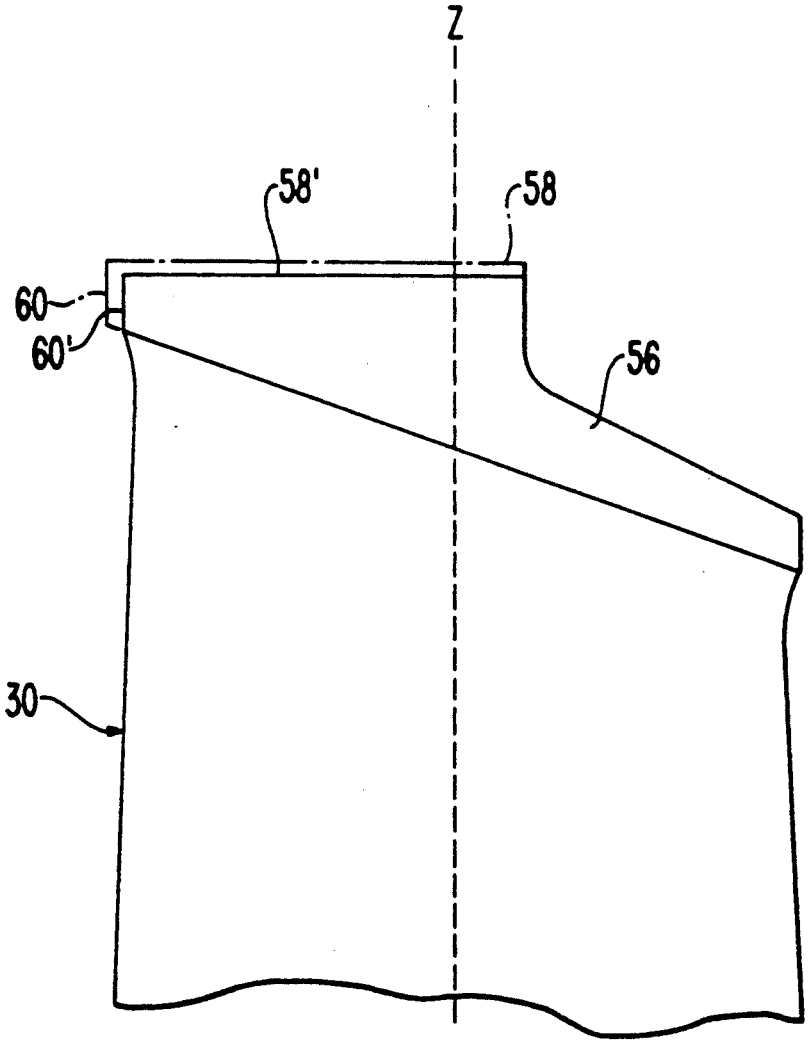
FIG. 11 is an enlarged side elevational view of the tip of a blade according to the present invention.

The optimized blade frequency, verified by test, is maintained for two slightly different designs which require different material. Since in some cases the fourth rotating blade row may operate in the transition zone, a corrosion resistant material is selected for these applications. To compensate for slightly different Young's modulus, an "envelope shroud" 56 is provided on the blade tip as shown in FIG. 11. As shown in FIG. 11, the shroud portion 56 of the blade 30 has an upper surface 58 and an outlet side surface 60, corresponding to a heavy shroud having a specific resonant frequency. A lighter shroud is indicated by the surfaces 58' and 60' and thus corresponds to a different frequency than that of the heavy shroud. The difference in frequency can be matched against the difference in frequency attributable to the different materials used to construct the blade and thus, going from a heavy shroud to a light shroud can be used as an effective tool to offset changes in resonant frequencies attributable to changes in Young's modulus. Thus, the blades having the general features described above can be customized to account for various materials used to construct the blades.

Another unique feature of the present blade design is that it has the highest non-dimensionalized blade height, i.e., aspect ratio, in the 3600 rpm tapered twisted integral shroud blade class. Generally, the higher the aspect ratio, the better the performance of the blade. A typical aspect ratio for blades in a low pressure turbine is about 4.0, while the aspect ratio of the blade of the present invention is about 4.7.

Also, the trailing edge geometry of the present blade is optimized to allow a novel manufacturing process. This allows for the first time a blade of this kind to be precision envelope forged or machined thus minimizing lead time and/or cost depending on circumstances. Moreover, the blade can be machined according to numeric control (NC) techniques from bar stock, again owing to the unique design of the blade. This allows the trailing edge to have a thinner dimension, and a thinner trailing edge gives better performance.

Another advantage to having an NC machined blade is that the tip section of the airfoil portion can be changed rather easily in the event that the flow field conditions are modified. For example, if steam is extracted downstream of the rotating blade, the extraction has the effect of necessitating a change in inlet angle. Thus, in order to compensate, it would be desirable to change the tip section of the blade. Thus, according to the present invention, if a change occurs due to a downstream extraction, the shape of the blade can be modified to have a corrected inlet angle relatively easily by NC machining. In contrast, a forged blade requires a large, expensive dye which cannot be altered to account for slight variations in blade shape, as would be required for a flow field variation attributable to an extraction, for example.

The blade described herein uses a straight side entry root of known configuration for mounting the blade in a correspondingly shaped groove on the rotor.

Numerous modifications and adaptations of the present invention will become apparent to those skilled in the art and thus, it is intended by the following claims to cover all such modifications and adaptations which fall within the true spirit and scope of the invention.

What is claimed is:

1. A tapered twisted rotating blade comprising:

a straight side-entry root portion;

a platform portion;

an airfoil portion integrally formed with the platform and root portions and having a base section disposed at the platform portion, thus constituting a proximal; end of the airfoil portion, and a tip section constituting an opposite, distal end of the airfoil portion, and a shroud segment integrally formed on the airfoil portion at the tip section, the airfoil portion of the blade being divided into five basic sections including the base section and the tip section, a quarter section, a mean section and a three quarter section, and the blade in each section defining a pitch and a chord with a pitch to chord ratio that increases linearly with length of the blade.

2. A tapered twisted rotating blade according to claim 1, wherein the airfoil portion includes a leading edge, a trailing edge, a convex suction-side surface and a concave pressure-side surface, and wherein the centers of the leading and trailing edges form a straight line.

3. A tapered twisted rotating blade according to claim 1, wherein each of said sections has a center of gravity, and wherein the airfoil portion has an approximate bending axis about which the airfoil portion tends to bend in response to a steam bending force acting normal to the bending axis, and wherein the centers of gravity of the five sections are disposed on an opposite side of the bending axis from a steam bending force vector.

4. A tapered twisted rotating blade according to claim 3, wherein, with the airfoil portion sections plotted on an X—X and Y—Y coordinate system, the centers of gravity of the five blade sections are in the first two quadrants of the coordinate system.

5. Blading for a BB71, or BB471 turbine according to the following table:

| | BASE | QUARTER | HALF | THREE QUARTER | TIP |
|---|---|---|---|---|---|
| RADIUS (IN) | 26.707 | 28.500 | 30.313 | 32.000 | 33.914 |
| WIDTH (IN) | 1.757 | 1.610 | 1.449 | 1.288 | 1.137 |
| CHORD (IN) | 2.432 | 2.396 | 2.358 | 2.338 | 2.328 |
| PITCH/WIDTH | .900 | 1.048 | 1.239 | 1.471 | 1.768 |
| PITCH/CHORD | .650 | .704 | .761 | .811 | .863 |
| STAGGER ANGLE (DEG) | 42.496 | 45.920 | 51.583 | 56.353 | 60.911 |
| MAXIMUM THICKNESS (IN) | .713 | .571 | .430 | .303 | .228 |
| MAX. THICKNESS/CHORD | .293 | .238 | .182 | .129 | .098 |
| TURNING ANGLE (DEG) | 103.000 | 91.239 | 75.126 | 51.114 | 46.590 |
| EXIT OPENING (IN) | .437 | .487 | .540 | .590 | .649 |
| EXIT OPENING ANGLE | 24.698 | 26.165 | 28.383 | 31.454 | 31.597 |
| INLET METAL ANGLE | 59.715 | 71.347 | 87.298 | 101.509 | 115.101 |
| INLET INCL. ANGLE | 82.389 | 74.336 | 57.438 | 43.312 | 39.916 |
| EXIT METAL ANGLE (DEG) | 17.283 | 17.413 | 17.575 | 17.375 | 18.308 |
| EXIT INCL. ANGLE (DEG) | 4.619 | 5.696 | 5.697 | 6.853 | 6.349 |
| SUCTION SURFACE TURNING | 9.723 | 11.601 | 13.658 | 17.505 | 15.464 |
| AREA (IN**2) | .993 | .782 | .583 | .436 | .340 |
| ALPHA (DEG) | 44.115 | 48.577 | 53.332 | 58.035 | 62.774 |
| FX (IN**(1-4)) | 13.494 | 27.966 | 65.818 | 170.108 | 468.529 |
| FY (IN**(1-4)) | 14.143 | 22.741 | 39.118 | 70.569 | 130.904 |
| FXY (IN**(1-4)) | 10.500 | 20.809 | 44.596 | 101.278 | 236.231 |
| I TOR (IN**4) | .080 | .043 | .019 | .007 | .003 |
| I MIN (IN**4) | .041 | .021 | .010 | .004 | .001 |
| I MAX (IN**4) | .301 | .228 | .169 | .133 | .106 |
| X BAR | .019 | .002 | −.013 | −.020 | −.012 |
| Y BAR | .017 | .019 | .012 | .007 | .010 |
| ZMINLE (IN**3) | −.077 | −.049 | −.028 | −.015 | −008 |
| ZMAXLE (IN**3) | .386 | .295 | .209 | .154 | .116 |
| ZMINTE (IN**3) | −.090 | −.059 | −.035 | −.020 | −.013 |
| ZMAXTE (IN**3) | −.785 | −.140 | −.109 | −.091 | −.076 |
| CMINLE (IN**3) | −.532 | −.439 | −.356 | −.276 | −.203 |
| CMAXLE (IN**3) | .781 | .773 | .807 | .863 | .913 |
| CMINTE (IN**3) | −.453 | −.365 | −.281 | −.207 | −.128 |
| CMAXTE (IN**3) | −1.690 | −1.621 | −1.536 | −1.462 | −1.398 |

* * * * *